US005169328A

United States Patent [19]

Johnson

[11] Patent Number: 5,169,328

[45] Date of Patent: Dec. 8, 1992

[54] ATOMIC BEAM TUBE ASSEMBLY

[75] Inventor: James L. Johnson, Scotts Valley, Calif.

[73] Assignee: Hewlett-Packard Company, Palo Alto, Calif.

[21] Appl. No.: 739,002

[22] Filed: Aug. 1, 1991

[51] Int. Cl.[5] ..... H01R 13/66; H01R 13/703

[52] U.S. Cl. ..... 439/188; 439/620

[58] Field of Search ..... 439/188, 620; 307/40, 307/125, 140, 147; 364/709.1; 340/531-538; 375/36

[56] References Cited

U.S. PATENT DOCUMENTS 4,450,487 5/1984 Koide ..... 358/210
4,760,375 7/1988 Stecker ..... 439/59
4,782,393 11/1988 Kawamura ..... 307/140
4,794,269 12/1988 Kawata et al. ..... 307/147
4,851,708 7/1989 Palmer ..... 307/140
4,915,639 4/1990 Cohn et al. ..... 439/188
4,972,470 11/1990 Farago ..... 380/3

FOREIGN PATENT DOCUMENTS 221858 5/1987 European Pat. Off. ..... 439/188

*Primary Examiner*—Neil Abrams

[57] ABSTRACT

An improved atomic beam tube assembly is disclosed in which the operating parameters for the atomic beam tube are contained in a programmable read-only membery located in the end of the cable used for connecting the atomic beam tube assembly to the support electronics. This arrangement eliminates the selected resistors normally used with such beam tube assemblies.

1 Claim, 1 Drawing Sheet

ATOMIC BEAM TUBE ASSEMBLY

FIELD OF THE INVENTION

The present invention relates to electronic assemblies with replaceable sub-assemblies, and more particularly, to an improved beam tube arrangement for a cesium beam tube.

BACKGROUND OF THE INVENTION

Many modern technological applications require precise frequency standards or clocks. For example, very precise navigational systems depend on clocks of extremely high accuracy. Atomic frequency standards form the basis for many such systems. One class of atomic beam standard that has found wide acceptance is based on a cesium beam tube. Cesium beam units are the present basis for most of the national standards of frequency and time. These standards are accurate to a few parts in $10^{12}$.

The cesium beam tube is used to define a very precise microwave frequency. The tube provides a feedback mechanism for controlling the frequency of an oscillator based on the difference between the oscillator frequency and a resonant frequency of the cesium atom. The tube includes a cesium source that operates in a vacuum and various electronically driven components. The components in the tube age with time, and eventually, the entire tube must be replaced.

Each tube is characterized at its time of manufacture. The resulting characterization data is used to specify various operating parameters unique to each tube. The electronic assembly that utilizes the tube requires the operating parameters to operate satisfactorily. In prior art systems, the characterization data is used to compute the values of a number of resistors which form a portion of the electronic assembly. The construction of the typical tube does not provide a convenient location on the tube housing for mounting such electronic components; hence, the selected resistors are mounted on the printed circuit board which connects to the tube. The resistors corresponding to a given tube are shipped with the tube. In these systems, when a tube is replaced, the accompanying resistors must be substituted for those corresponding to the previous tube. This replacement operation typically involves removing the old resistors and soldering the new resistors into a printed circuit card.

This approach has a number of problems. First, the resistors may be lost in transit. Second, the replacement operation may result in damage to the printed circuit board or resistors. Finally, the operation is time consuming and not easily accomplished in the field.

Broadly, it is the object of the present invention to provide an improved atomic beam tube.

It is another object of the present invention to provide an atomic beam tube assembly in which the operating parameters are embodied in components which are permanently connected to the tube.

These and other objects of the present invention will become apparent to those skilled in the art from the following detailed description of the invention and the accompanying drawings.

SUMMARY OF THE INVENTION

The present invention comprises an improved beam tube assembly. The assembly includes a housing and a connecting cable. The housing contains components which are to be electrically connected to an electronic assembly remote from the housing. The cable has first and second ends and a plurality of conductors, the first end being connected to the housing and providing connections between the conductors and the components in the housing. The second end terminates in a first connector adapted to mate with a second connector on the electronic assembly. The first connector includes a read-only memory which may be read by the electronic assembly. The read-only memory stores data specifying the operating parameters of the components in said housing.

DETAILED DESCRIPTION OF THE INVENTION

Figure 1:
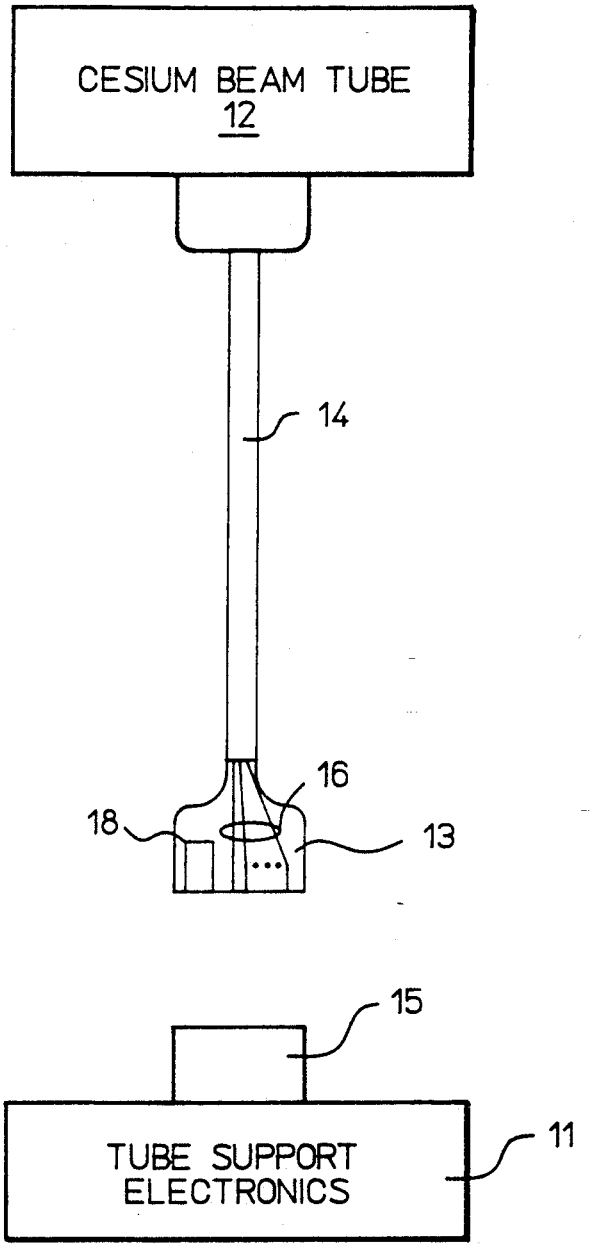
FIG. 1 illustrates an atomic beam tube assembly, according to the present invention, and the corresponding support electronics.

FIG. 1 illustrates an atomic beam tube assembly, according to the present invention, and the corresponding support electronics. The cesium beam tube components are contained in a metal housing 12. The components are connected to the tube support electronics 11 via a cable 14 which is permanently attached to the metal housing. Cable 14 contains a number of conductors which are shown at 16. The end of cable 14 that is not connected to the metal housing mates with a corresponding connector 15 on the tube support electronics printed circuit board. Connector 13 also includes a PROM 18 which is used to store the operating parameters for the tube assembly. The PROM is mounted such that it can be powered and read by appropriate signals on a sub-set of the normally unused pins in connector 13. The PROM is loaded with the operating parameters prior to the shipment of the tube to the end-user. The tube support electronics used in conjunction with the present invention read the digital values stored in the PROM instead of relying on precision resistors to communicate the tube operating parameters.

The present invention has a number of advantages over the prior art systems relying on selected resistors. The PROM can be automatically loaded from the characterization test equipment. This reduces the chance of error. In addition, the amount of labor needed to prepare a tube for shipment is reduced, since manual selection of resistors and the packaging of the same has been eliminated. Since the cable is permanently attached to the metal housing, possible loss of the operating parameters is essentially eliminated. Finally, beam tubes can be changed by simply unplugging the old tube and plugging in the new one.

While the present invention has been described with reference to a cesium beam tube, it will be apparent to those skilled in the art that the present invention may be used advantageously in any situation in which electronic components in a first housing require operating parameters to operate a set of components in a second housing remote from the first housing.

There has been described herein a novel cesium beam tube assembly for use in atomic clocks and the like. Various modifications to the present invention will become apparent to those skilled in the art from the foregoing description and accompanying drawings. Accordingly, the present invention is to be limited solely by the scope of the following claims.

What is claimed is:

1. An assembly comprising a housing and a connecting cable, said housing containing an atomic beam tube which is to be electrically connected to an electronic assembly remote from said housing, said cable having first and second ends and a plurality of conductors, said first end being connected to said housing and providing connections between said conductors and said an atomic beam tube in said housing, said second end comprising a first connector adapted to mate with a second connector on said electronic assembly, said first connector comprising an electrically readable read-only memory which may be read by said electronic assembly, said read-only memory comprising means for storing data specifying the operating parameters of said an atomic beam tube in said housing.

* * * * *